US009742157B2

(12) United States Patent
Mitsuda et al.

(10) Patent No.: US 9,742,157 B2
(45) Date of Patent: Aug. 22, 2017

(54) SPARK PLUG

(71) Applicant: NGK SPARK PLUG CO., LTD., Nagoya-shi, Aichi (JP)

(72) Inventors: Shinya Mitsuda, Inuyama (JP); Yuichi Yamada, Aichi (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/025,609

(22) PCT Filed: Aug. 20, 2014

(86) PCT No.: PCT/JP2014/004262

§ 371 (c)(1),
(2) Date: Mar. 29, 2016

(87) PCT Pub. No.: WO2015/063987

PCT Pub. Date: May 7, 2015

(65) Prior Publication Data

US 2016/0218486 A1 Jul. 28, 2016

(30) Foreign Application Priority Data

Oct. 28, 2013 (JP) ..... 2013-222947

(51) Int. Cl.
*H01T 13/20* (2006.01)
*H01T 13/38* (2006.01)

(52) U.S. Cl.
CPC ..... *H01T 13/20* (2013.01); *H01T 13/38* (2013.01)

(58) Field of Classification Search
CPC ..... H01T 13/20; H01T 13/38
See application file for complete search history.

(56) References Cited

U.S. PATENT DOCUMENTS 6,603,246 B2 8/2003 Hori ..... 313/141
6,611,084 B2 8/2003 Teramura et al. ..... 313/141
(Continued)

FOREIGN PATENT DOCUMENTS

CN 101978565 A 2/2011 ..... F02P 13/00
EP 1 976 080 A2 10/2008 ..... H01T 13/50
(Continued)

OTHER PUBLICATIONS

International Search Report issued in corresponding International Patent Application No. PCT/JP2014/004262, dated Sep. 16, 2014.
Office Action received in corresponding Chinese Patent Application No. 201480057645.7, dated Sep. 21, 2016.
Search Report issued in corresponding European Application No. 14858231.5 dated May 18, 2017.

*Primary Examiner* — Joseph L Williams
*Assistant Examiner* — Jose M Diaz
(74) *Attorney, Agent, or Firm* — Kusner & Jaffe

(57) ABSTRACT

A spark plug includes an insulator having a through hole formed in the direction of an axis, a rod-shaped center electrode inserted in the through hole and extending in the direction of the axis, a metal shell disposed around an outer circumference of the insulator, and a ground electrode electrically conducted with the metal shell and adapted to define a gap between the ground electrode and the center electrode. A front end part of the insulator has a front end surface, an outer circumferential surface and a curved surface region formed between the front end surface and the outer circumferential surface. In a cross section including the axis, a front end of an inner circumferential surface of the metal shell faces the curved surface region in a direction perpendicular to the axis. The curved surface region has a curvature radius of 0.2 mm to 0.8 mm.

6 Claims, 3 Drawing Sheets

(56) References Cited

U.S. PATENT DOCUMENTS

| | | | | |
|---|---|---|---|---|
| 2001/0015602 | A1 | 8/2001 | Hori | 313/141 |
| 2002/0067110 | A1* | 6/2002 | Nishikawa | H01T 13/38 313/118 |
| 2003/0001474 | A1 | 1/2003 | Teramura et al. | 313/141 |
| 2005/0104497 | A1* | 5/2005 | Fischer | H01T 13/36 313/144 |
| 2007/0228916 | A1* | 10/2007 | Kunitomo | H01T 13/32 313/143 |
| 2008/0238281 | A1 | 10/2008 | Nakamura et al. | 313/141 |
| 2011/0000453 | A1 | 1/2011 | Kuribayashi et al. | 123/169 R |
| 2013/0009535 | A1* | 1/2013 | Mori | H01T 13/20 313/141 |
| 2013/0015756 | A1* | 1/2013 | Yamada | H01T 13/36 313/143 |
| 2016/0064903 | A1* | 3/2016 | Deguchi | H01T 13/32 313/120 |

FOREIGN PATENT DOCUMENTS

| | | | | |
|---|---|---|---|---|
| EP | 2 259 393 | A2 | 12/2010 | H01T 13/20 |
| JP | H08-298177 | A | 11/1996 | C22C 19/00 |
| JP | H09-027379 | A | 1/1997 | B23P 13/00 |
| JP | H09-266056 | A | 10/1997 | H01T 13/20 |
| JP | H10-041047 | A | 2/1998 | H01T 13/14 |
| JP | 2001-307857 | A | 11/2001 | F02P 13/00 |
| JP | 2002-260816 | A | 9/2002 | F02P 13/00 |
| JP | 2002-270332 | A | 9/2002 | H01T 13/20 |
| JP | 2007-080833 | A | 3/2007 | C22C 5/04 |
| JP | 2011-210514 | A | 10/2011 | H01T 13/46 |

* cited by examiner

SPARK PLUG

RELATED APPLICATIONS

This application is a National Stage of International Application No. PCT/JP2014/004262 filed Aug. 20, 2014, which claims the benefit of Japanese Patent Application No. 2013-222947, filed Oct. 28, 2013.

FIELD OF THE INVENTION

The present invention relates to a spark plug used for ignition in an internal combustion engine etc.

BACKGROUND OF THE INVENTION

A spark plug has a center electrode and a ground electrode kept insulated from each other by an insulator. There is a spark discharge gap defined between a front end portion of the center electrode and a distal end portion of the ground electrode. With the application of a voltage between the center electrode and the ground electrode, the spark plug generates a spark discharge within the spark discharge gap. Under the influence of such voltage application, however, a penetration breakage may occur in the insulator between the center electrode and the ground electrode. This results in the problem that the spark discharge cannot be properly generated within the spark discharge gap due to the flow of electric current through a broken site of the insulator.

In recent years, there is a tendency that the voltage applied to the spark plug increases with higher compression of fuel gas in internal combustion engines.

As the voltage applied to the spark plug increases, it becomes more likely that the penetration breakage will occur in the insulator of the spark plug. There has thus been a demand to establish techniques for preventing the occurrence of the penetration breakage in the insulator.

An advantage of the present invention is a spark plug capable of preventing a penetration breakage in an insulator.

SUMMARY OF THE INVENTION

The present invention has been made to solve at least part of the above problems and can be embodied as the following application examples.

Application Example 1

In accordance with a first aspect of the present invention, there is provided a spark plug, comprising:

an insulator having a through hole formed in the direction of an axis of the spark plug;

a rod-shaped center electrode inserted in the through hole and extending in the direction of the axis;

a metal shell disposed around an outer circumference of the insulator; and a ground electrode electrically conducted with the metal shell and adapted to define a gap between the ground electrode and the center electrode, wherein a front end part of the insulator has a front end surface, an outer circumferential surface extending toward the rear from the front end surface in the direction of the axis and a curved surface region formed between the front end surface and the outer circumferential surface;

wherein, in a cross section including the axis, a front end of an inner circumferential surface of the metal shell faces the curved surface region in a direction perpendicular to the axis; and wherein the curved surface region has a curvature radius of 0.2 mm (millimeters) to 0.8 mm (millimeters).

As an example of the occurrence of an unintentional spark discharge in a space other than the gap, it is conceivable that a spark discharge occurs between the front end of the inner circumferential surface of the metal shell and the center electrode.

In the above configuration, the front end of the inner circumferential surface of the metal shell is arranged to face the curved surface region of the front end part of the ceramic insulator in the direction perpendicular to the axis; and the curvature radius of the curved surface region is set larger than or equal to 0.2 mm (millimeters) and smaller than or equal to 0.8 mm (millimeters). It is thus likely that, when a spark discharge occurs between the front end of the front end of the inner circumferential surface of the metal shell and the center electrode, the spark discharge will reach the center electrode via a path along the curved surface region and the front end surface of the insulator (also called "creepage path"). It is accordingly possible to prevent the spark discharge from reaching the center electrode via a path through the inside of the insulator (also called "penetration path), i.e., possible to prevent the occurrence of a penetration breakage in the insulator.

By setting the curvature radius of the curved surface region to be larger than or equal to 0.2 mm (millimeters) and smaller than or equal to 0.8 mm (millimeters), it is particularly possible to increase the likelihood of the creepage path of the spark discharge for effective prevention of the penetration breakage in the insulator.

Application Example 2

In accordance with a second aspect of the present invention, there is provided a spark plug according to Application Example 1, wherein the outer circumferential surface of the insulator increases in outer diameter from a front end to a rear end thereof.

It becomes more likely that the spark discharge will occur as the density of the ambient air decreases with increase in temperature. By contrast, it becomes less likely that the spark discharge will occur as the density of the ambient air increase with decrease in temperature.

In the above configuration, the volume of the insulator in the vicinity of the front end of the insulator decreases toward the front end. As a result, the temperature in the vicinity of the insulator becomes higher toward the front end of the insulator and becomes lower toward the rear end of the insulator. This leads to an increase in the likelihood that the spark discharge will develop via the creepage path along the front end surface of the insulator and a decrease in the likelihood that the spark discharge will develop via the penetration path on the rear side with respect to the front end surface of the insulator. It is thus possible to more effectively prevent the occurrence of the penetration breakage in the insulator.

Application Example 3

In accordance with a third aspect of the present invention, there is provided a spark plug according to Application Example 1 or 2, wherein, in the cross section including the axis, two contours of the outer circumferential surface of the insulator form an acute angle of 5 degrees to 30 degrees.

In the above configuration, the acute angle between the two contours of the outer circumferential surface of the insulator in the cross section including the axis (also called the "taper angle" of the insulator) is set larger than or equal to 5 degrees. It is thus possible to decrease the discharge voltage of the spark discharge via the creepage path by increasing the temperature of the front end of the insulator to a relatively high value and thereby possible to suppress the occurrence of damage to the front end of the insulator.

Further, the taper angle of the insulator is set smaller than or equal to 30 degrees. It is thus possible to prevent the overheating of the front end of the insulator and thereby possible to reduce the possibility of misfiring such as pre-ignition caused by such an overheated front end of the insulator during operation of the internal combustion engine.

It should be noted that the present invention can be embodied in various forms such as not only the spark plug but also an internal combustion engine to which the spark plug is mounted and the like.

DETAILED DESCRIPTION OF THE PREFERRED EMBODIMENTS

A. Embodiment

A-1. Structure of Spark Plug

One exemplary embodiment of the present invention will be described below.

Figure 1:
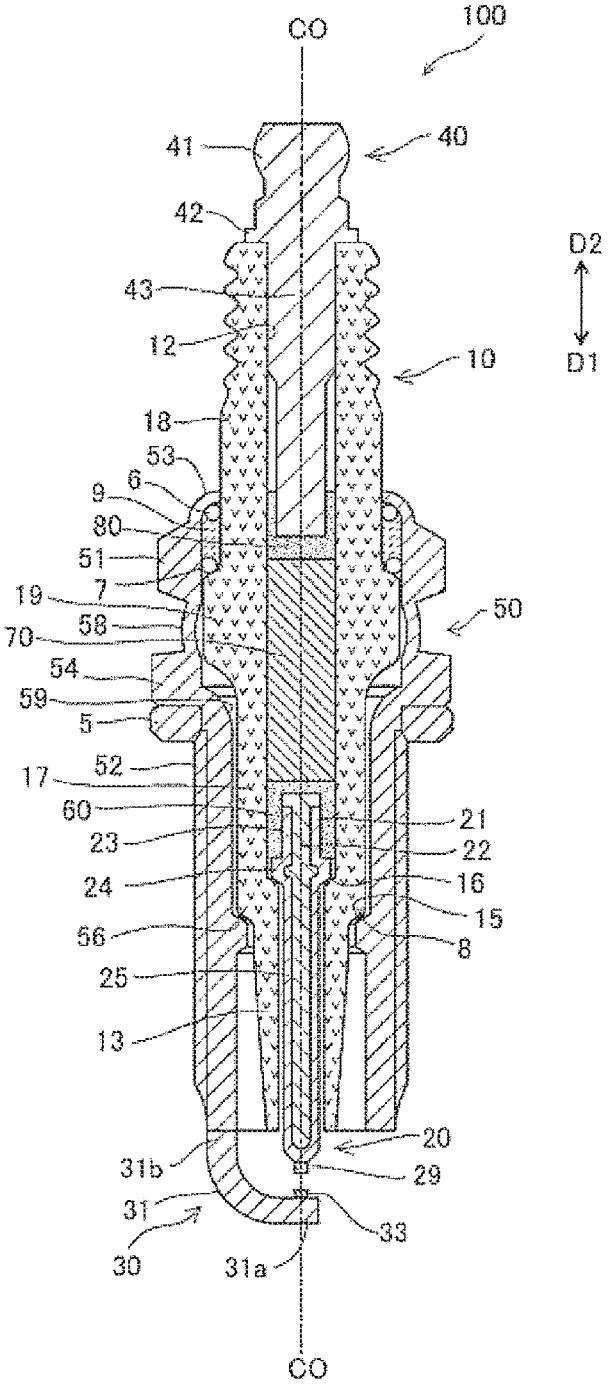
FIG. 1 is a cross sectional view of a spark plug 100 according to one exemplary embodiment of the present invention.

FIG. 1 is a cross sectional view of a spark plug 100 according to the present embodiment. In FIG. 1, dashed line indicates an axis CO of the spark plug 100 (also simply referred to as "axis CO"). The direction parallel to the axis CO (i.e. the vertical direction of FIG. 1) is simply referred to as "axial direction"; the direction of a radius of a circle about the axis CO is simply referred to as "radial direction"; and the direction of a circumference of a circle about the axis CO is simply referred to as "circumferential direction". The direction toward the lower side of FIG. 1 is occasionally referred to as "frontward direction D1"; and the direction toward the upper side of FIG. 1 is occasionally referred to as "rearward direction D2." Further, the lower and upper sides of FIG. 1 are referred to as front and rear sides of the spark plug 100, respectively.

The spark plug 100 includes a ceramic insulator 10 as an insulator, a center electrode 20, a ground electrode 30, a metal terminal 40 and a metal shell 50.

The ceramic insulator 10 is made of e.g. sintered alumina and is substantially cylindrical-shaped, with a through hole 12 (as an axial hole) formed therethrough in the axial direction. The ceramic insulator 10 includes a collar portion 19, a rear body portion 18, a front body portion 17, a step portion 15 and a leg portion 13. The rear body portion 18 is located in rear of the collar portion 19 and is smaller in outer diameter than the collar portion 19. The front body portion 17 is located in front of the collar portion 19 and is smaller in outer diameter than the collar portion 19. The leg portion 13 is located in front of the front body portion 17 and is smaller in outer diameter than the front body portion 17. When the spark plug 100 is mounted to an internal combustion engine (not shown), the leg portion 13 is exposed to a combustion chamber of the internal combustion engine. The step portion 15 is formed between the leg portion 13 and the front body portion 17.

The metal shell 50 is made of a conductive metal material (such as low carbon steel) as a cylindrical fitting for fixing the spark plug 100 to an engine head (not shown) of the internal combustion engine. An insertion hole 59 is formed through the metal shell 50 along the axis CO. The metal shell 50 is disposed around an outer circumference of the ceramic insulator 10. In other words, the ceramic insulator 10 is inserted and held in the insertion hole 59 of the metal shell 50. The position of a front end of the ceramic insulator 10 in the axial direction is set substantially the same as the position of a front end of the metal shell 50 in the axial direction as will be explained later in detail. A rear end of the ceramic insulator 10 protrudes toward the rear from a rear end of the metal shell 50.

The metal shell 50 includes a tool engagement portion 51 formed into a hexagonal column shape for engagement with a spark plug wrench, a mounting thread portion 52 for mounting the spark plug 100 to the internal combustion engine and a collar-shaped seat portion 54 formed between the tool engagement portion 51 and the mounting thread portion 52. The nominal diameter of the mounting thread portion 52 is set to e.g. M8 (8 mm (millimeters)), M10, M12, M14 or M18.

An annular gasket 5, which is formed by bending a metal plate, is fitted around a part of the metal shell 50 between the seat portion 54 and the mounting thread portion 52. When the spark plug 100 is mounted to the internal combustion engine, the gasket 5 seals a clearance between the spark plug 100 and the internal combustion engine (engine head).

The metal shell 50 further includes a thin crimped portion 53 located in rear of the tool engagement portion 51 and a thin compression-deformed portion 58 located between the tool engagement portion 51 and the seat portion 54.

Annular ring members 6 and 7 are disposed in an annular space between an inner circumferential surface of part of the metal shell 50 from the tool engagement portion 51 to the crimped portion 53 and an outer circumferential surface of the rear body portion 18 of the ceramic insulator 10. Further, a talc powder (as a talc) 9 is filled between the ring members 6 and 7 within the annular space. A rear end of the crimped portion 53 is bent radially inwardly and fixed to the outer circumferential surface of the ceramic insulator 10. The compression-deformed portion 58 is subjected to compression deformation by pushing the crimped portion 53 toward the front, with the crimped portion 53 being fixed to the outer circumferential surface of the ceramic insulator 10, during manufacturing process. By the compression deformation of the compression-deformed portion 58, the ceramic insulator 10 is pushed toward the front within the metal shell 50 through the ring members 6 and 7 and the talc powder 9. The step portion 15 of the ceramic insulator 10 (as a ceramic-insulator-side step portion) is then pressed against a step portion 56 of the metal shell 50 (as a metal-shell-side step portion), which is formed on an inner circumferential side of the mounting thread portion 52, through an annular metal plate packing 8 so that the plate packing 8 can prevent gas from leaking from the combustion chamber of the internal combustion engine to the outside through a clearance between the metal shell 50 and the ceramic insulator 10.

The center electrode 20 is rod-shaped along the axis CO and inserted in the through hole 12 of the ceramic insulator 10. The center electrode 20 has an electrode body 21 and a core 22 embedded in the electrode body 21. The electrode body 21 is made of e.g. nickel or nickel-based alloy (e.g. Inconel 600 (trademark)). The core 22 is made of e.g. copper or copper-based alloy higher in thermal conductivity than that of the electrode body 21. A front end of the center electrode 20 is exposed to the front from the ceramic insulator 10.

The center electrode 20 includes a collar portion 24 (also referred to as "electrode collar" or "flanged portion") located at a predetermined position in the axial direction, a head portion 23 (as an electrode head) located in rear of the collar portion 24 and a leg portion 25 (as an electrode leg) located in front of the collar portion 24. The collar portion 24 is supported on a step portion 16 of the ceramic insulator 10. A front end part of the leg portion 25 protrudes from the front end of the ceramic insulator 10. An electrode tip 29 is joined by e.g. laser welding to the front end part of the leg portion 25. The electrode tip 29 is made of a material containing a high-melting noble metal as a main component. As such a material of the electrode tip 29, there can be used e.g. iridium (Ir) or Ir-based alloy such as Ir-5Pt alloy (i.e. iridium alloy containing 5 mass % of platinum).

The ground electrode 30 has an electrode body 31 and an electrode tip 33 and is joined to the front end of the metal shell 50. The electrode body 31 is made of a highly corrosion resistant metal material such as nickel alloy e.g. Inconel 600. A base end portion 31*b* of the electrode body 31 is joined by welding to a front end surface of the metal shell 50, thereby providing electrical conduction between the ground electrode 30 and the metal shell 50. The electrode body 31 is bent such that one side of an end portion 31*a* of the electrode body 31 opposite from the base end portion 31*b* axially faces the electrode tip 29 of the center electrode 20 on the axis CO. The electrode tip 33 is welded to the one side of the end portion 31*a* of the electrode body 31 so as to correspond in position to the electrode tip 29 of the center electrode 20. The electrode tip 33 is made of e.g. Pt (platinum) or Pt-based alloy such as Pt-20Ir alloy (i.e. platinum alloy containing 20 mass % of iridium). There is a spark discharge gap defined between the electrode tip 29 of the center electrode 20 and the electrode tip 33 of the ground electrode 30.

The metal terminal 40 is rod-shaped along the axis CO and is made of a conductive metal material (such as low carbon steel). A metal layer (such as Ni layer) for corrosion protection is formed by plating etc. on a surface of the metal terminal 40. The metal terminal 40 includes a collar portion 42 (as a terminal collar), a cap attachment portion 41 located in rear of the collar portion 42 and a leg portion 43 (as a terminal leg) located in front of the collar portion 42. The cap attachment portion 41 of the metal terminal 40 is exposed to the rear from the ceramic insulator 10. The leg portion 43 of the metal terminal 40 is inserted (press-fitted) in the through hole 12 of the ceramic insulator 10. A plug cap to which a high-voltage cable (not illustrated) is connected is attached to the cap attachment portion 41 so as to apply therethrough a high voltage for generation of a spark discharge.

A resistor 70 is disposed between a front end of the metal terminal 40 (leg portion 43) and a rear end of the center electrode 20 (head portion 23) within the through hole 12 of the ceramic insulator 10 so as to reduce radio noise during the generation of the spark discharge. The resistor 70 is made of e.g. a composition containing particles of glass as a main component, particles of ceramic other than glass and a conductive material. A conductive seal 60 is filled in a clearance between the resistor 70 and the center electrode 20 within the through hole 12. A conductive seal 80 is filled in a clearance between the resistor 70 and the metal terminal 40 within the through hole 12. The conductive seals 60 and 80 are each made of e.g. a composition containing particles of glass such as $B_2O_3$—$SiO_2$ glass and particles of metal (such as Cu or Fe).

A-2. Configuration of Front End Part of Center Electrode

Figure 2A:
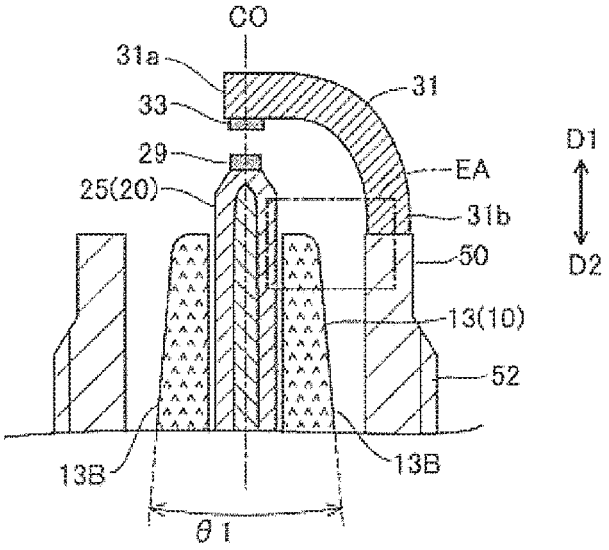
FIG. 2(A) and FIG. 2(B) are cross sectional views of a front end part of the spark plug 100.
Figure 2B:
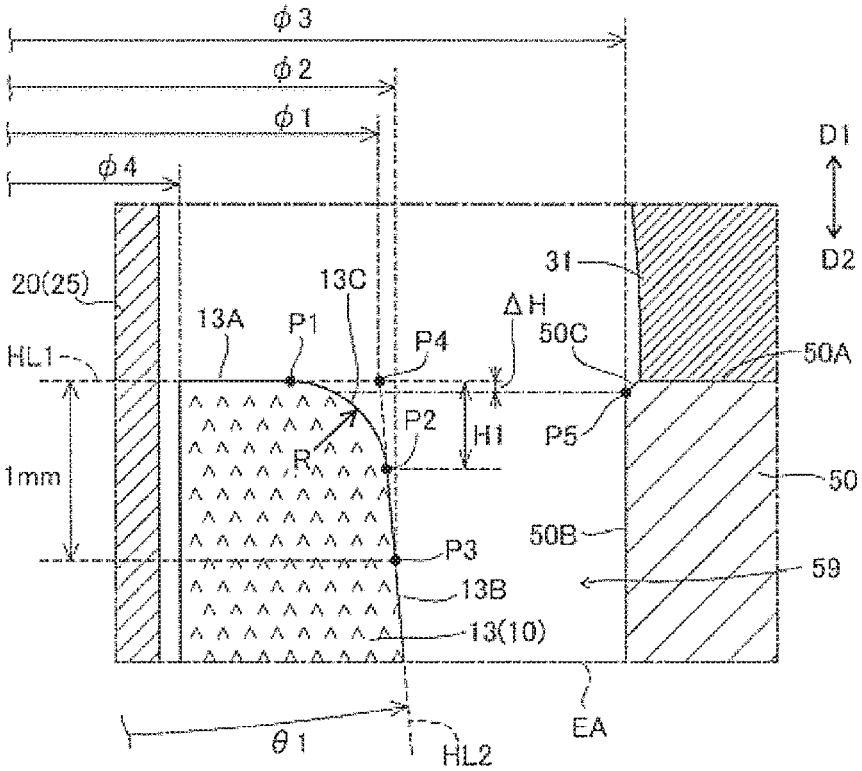

The configuration of a front end part of the spark plug 100 will be explained in more detail below. FIG. 2(A) is a cross sectional view of the front end part of the spark plug 100 as taken along a plane including the axis CO. FIG. 2(B) is an enlarged cross section view of an area surrounded by dashed line EA in FIG. 2(A). The frontward direction D1 corresponds to the direction toward the upper side of FIG. 2; and the rearward direction D2 corresponds to the direction toward the lower side of FIG. 2.

As the cross section of the front end part of the spark plug 100, except the ground electrode 30, is symmetrical about the axis CO as shown in FIG. 2(A), the right side of the cross section of FIG. 2(A) with respect to the axis CO will be mainly explained below with reference to FIG. 2(B). It is however understood that the left side of the cross section of FIG. 2(A) with respect to the axis CO is similar in configuration to the right side.

As shown in FIG. 2(B), a front end part of the leg portion 13 (ceramic insulator 10) has a front end surface 13A, an outer circumferential surface 13B and a curved surface region 13C. The front end surface 13A is oriented perpendicular to the axis O. The outer circumferential surface 13B is located in rear of the front end surface 13A and extends toward the rear in the axial direction (i.e. extends in the rearward direction D2). The curved surface region 13C is formed between the front end surface 13A and the outer circumferential surface 13B.

In the cross section of FIG. 2(B), P1 designates a point on an outer periphery of the front end surface 13A, that is, a front end of the curved surface region 13C; and P2 designates a front end of the outer circumferential surface 13B, that is, a rear end of the curved surface region 13C. It is herein defined that, in the cross section of FIG. 2(B), HL1 is an imaginary extension line of the front end surface 13A (extending perpendicular to the axis CO); and HL2 is an imaginary extension line of the outer circumferential surface 13B. It can be said that the curved surface region 13C is an outer surface region of the ceramic insulator 10 situated apart from the two imaginary lines HL1 and HL2 in the cross section of the FIG. 2(B).

It is also defined that H1 is a length of the curved surface region 13C in the axial direction, i.e., a distance from the front end P1 of the curved surface region 13C to the rear end P2 of the curved surface region 13C in the axial direction.

The curved surface region 13C is formed by, during production of the ceramic insulator 10, grinding the green ceramic insulator body with the use of a grinding stone and thereby adjusting the outer shape of the ceramic insulator 10. The curved surface region 13C is annular in shape throughout the entire outer circumferential edge of the front end part of the leg portion 13. The radius R of curvature of the curved surface region 13C is expressed in terms of a radius of a circular arc contour of the curved surface region 13C in the cross section of FIG. 2(B).

In the cross section of FIG. 2(B), P4 designates a point of intersection of the imaginary extension line HL1 of the front end surface 13A and the imaginary extension line HL2 of the outer circumferential surface 13B; and P3 designates a point located on the outer circumferential surface 13B at 1 mm away from the front end surface 13A of the ceramic insulator 10 in the axial direction.

Herein, the dimension twice as large as a distance from the axis CO to the point P4 in the radial direction is defined as a first outer diameter $\phi$1 (also called "front end diameter $\phi$1") of the ceramic insulator 10 (leg portion 13); and the dimension twice as large as a distance from the axis CO to the point P3 in the radial direction, i.e., the outer diameter of the ceramic insulator 10 at 1 mm away from the front end surface 13A of the ceramic insulator 10 in the axial direction is defined as a second outer diameter $\phi 2$ of the ceramic insulator 10. In FIG. 2(B), the second outer diameter $\phi 2$ is set larger than the first outer diameter $\phi 1$ ($\phi 2 > \phi 1$). Namely, the outer circumferential surface 13B of the leg portion 13 of the ceramic insulator 10 increases in outer diameter from the front end toward the rear end. Thus, the leg portion 13 of the ceramic insulator 10 has a tapered shape increasing in diameter from the front toward the rear. The shape of the leg portion 13 is not however limited to that of FIG. 2(B). The second outer diameter $\phi 2$ may alternatively be set equal to the first outer diameter $\phi 1$.

In the cross section of FIG. 2(A), the outer circumferential surface 13B of the ceramic insulator 10 (leg portion 13) has two contours on both sides of the axis CO. It is defined that $\theta 1$ is the angle between these two contours, i.e., the acute angle between two contours of the outer circumferential surface in the cross section of FIG. 2(A). This angle $\theta 1$ is also called the taper angle of the front end of the ceramic insulator 10.

The first outer diameter $\phi 1$ of the ceramic insulator 10 is not limited to, but is preferably in the range of 3 mm to 5.5 mm, more preferably 3.6 mm to 4.3 mm. The inner diameter $\phi 4$ of the front end part of the ceramic insulator 10 (i.e. the inner diameter of the part of the ceramic insulator 10 through which the leg portion 25 of the center electrode 20 is inserted) is not limited to, but is preferably in the range of 3.1 mm to 5.55 mm, more preferably 3.7 mm to 4.35 mm.

On the other hand, a front end part of the metal shell 50 has a front end surface 50A, an inner circumferential surface 50B and a chambered region 50C formed between the front end surface 50A and the inner circumferential surface 50B. The inner diameter of the inner circumferential surface 50B of the metal shell 50 (i.e. the inner diameter of the insertion hole 59) located in front of the step portion 56 of FIG. 1 is set to a fixed value $\phi 3$. This value $\phi 3$ is also called the inner diameter of the front end part of the metal shell 50. The inner diameter $\phi 3$ is not limited to, but is preferably in the range of 5.5 mm to 8.5 mm, more preferably 7.0 mm to 7.5 mm. It should be noted that each of $\phi 1$ to $\phi 4$ refers to a diameter rather than a radius.

In the cross section of FIG. 2(B), P5 designates a front end of the inner circumferential surface 50B, that is, a rear end of the chamfered region 50C. In the case where the chamfered region 50 is not formed on the front end part of the metal shell 50, the front end P5 of the inner circumferential surface 50B corresponds to a point of intersection of the front end surface 50A and the inner circumferential surface 50B.

The position of the front end surface 13A of the ceramic insulator 10 in the axial direction with respect to the position of the front end P5 of the inner circumferential surface 50B of the metal shell 50 in the axial direction is expressed in terms of $\Delta H$ (see FIG. 2(A)). It can be said that $\Delta H$ represents the position of the front end P1 of the curved surface region 13C of the ceramic insulator 10 with respect to the position of the front end P5 of the inner circumferential surface 50B of the metal shell 50 in the axial direction. Herein, $\Delta H$ takes a positive value in the case where the front end P1 of the curved surface region 13C of the ceramic insulator 10 is situated in the frontward direction D1 relative to the front end P5 of the inner circumferential surface 50B of the metal shell 50. In the case where the front end P1 of the curved surface region 13C of the ceramic insulator 10 is situated in the rearward direction D2 relative to the front end P5 of the inner circumferential surface 50B of the metal shell 50, $\Delta H$ takes a negative value.

When $\Delta H$ is larger than or equal to 0 and, at the same time, is smaller than the length H1 of the curved surface region 13C in the axial direction ($0 \leq \Delta H \leq H1$), the front end P5 of the inner circumferential surface 50B of the metal shell 50 is located in rear of the front end P1 of the curved surface region 13C of the ceramic insulator 10 and is located in front of the rear end P2 of the curved surface region 13C of the ceramic insulator 10. This means that, when $0 \leq \Delta H \leq H1$, the front end P5 of the inner circumferential surface 50B of the metal shell 50 is arranged to face the curved surface region 13C of the ceramic insulator 10 in a direction perpendicular to the axial direction. The condition of $0 \leq \Delta H \leq H1$ is satisfied in FIG. 2(B).

When $\Delta H$ is negative in value ($\Delta H < 0$), the front end P5 of the inner circumferential surface 50B of the metal shell 50 is located in front of the front end P1 of the curved surface region 13C of the ceramic insulator 10.

Figure 3:
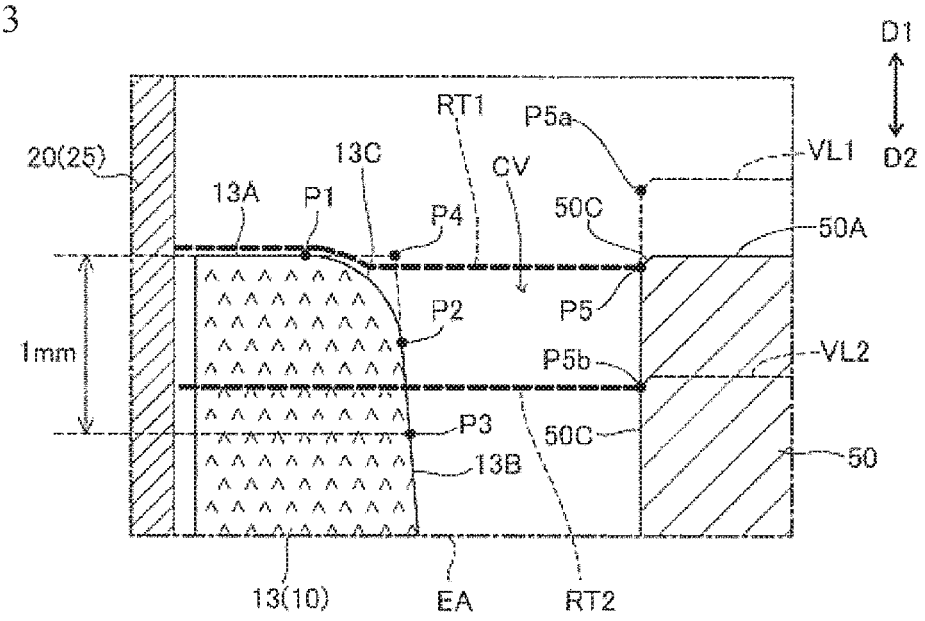
FIG. 3 is a schematic view showing the configuration of the front end part of the spark plug 100.

FIG. 3 is a schematic view showing the configuration of the front end part of the spark plug 100.

For example, in the case where the front end surface 50A of the metal shell 50 is situated as indicated by broken line VL1 in FIG. 3, the front end of the inner circumferential surface 50B (as designated by P5 a in FIG. 3) is located in front of the front end P1 of the curved surface region 13C of the ceramic insulator 10. This means that the condition of $\Delta H < 0$ holds.

When $\Delta H$ is larger than the length H1 of the curved surface region 13C in the axial direction ($\Delta H > H1$), the front end P5 of the inner circumferential surface 50B of the metal shell 50 is located in rear of the rear end P2 of the curved surface region 13C of the ceramic insulator 10.

For example, in the case where the front end surface 50A of the metal shell 50 is situated as indicated by broken line VL2 in FIG. 3, the front end of the inner circumferential surface 50B (as designated by P5*b* in FIG. 3) is located in rear of the rear end P2 of the curved surface region 13C of the ceramic insulator 10. This means that the condition of $\Delta H > H1$ holds.

The following explanation will be given of evaluation tests conducted on samples of the spark plug 100.

B. Evaluation Test 1

In Evaluation Test 1, 16 types of spark plug samples 1-1to 1-16 were prepared and subjected to discharge test as shown in TABLE 1. The common dimensions of the spark plug samples were as follows: the inner diameter $\phi 4$ of the front end part of the ceramic insulator 10 was 2.3 mm; and the inner diameter $\phi 3$ of the front end part of the metal shell 50 was 7.2 mm.

TABLE 1

| Sample No. | $\Delta H$ (mm) | H1 (mm) | R (mm) | $\phi 1$ (mm) | $\phi 2$ (mm) | Test operation A | Test operation B | Evaluation |
|---|---|---|---|---|---|---|---|---|
| 1-1 | −0.1 | 0.36 | 0.4 | 4.1 | 4.3 | breakage | breakage | X |
| 1-2 | 0 | 0.36 | 0.4 | 4.1 | 4.3 | no breakage | no breakage | ◎ |
| 1-3 | 0.05 | 0.36 | 0.4 | 4.1 | 4.3 | no breakage | no breakage | ◎ |
| 1-4 | 0.35 | 0.36 | 0.4 | 4.1 | 4.3 | no breakage | no breakage | ◎ |
| 1-5 | 0.4 | 0.36 | 0.4 | 4.1 | 4.3 | breakage | breakage | X |

TABLE 1-continued

| Sample No. | ΔH (mm) | H1 (mm) | R (mm) | ϕ1 (mm) | ϕ2 (mm) | Test operation A | Test operation B | Evaluation |
|---|---|---|---|---|---|---|---|---|
| 1-6 | 0.7 | 0.72 | 0.8 | 4.1 | 4.3 | no breakage | no breakage | ◎ |
| 1-7 | 0.75 | 0.72 | 0.8 | 4.1 | 4.3 | breakage | breakage | X |
| 1-8 | 0.05 | 0.09 | 0.1 | 4.1 | 4.3 | breakage | breakage | X |
| 1-9 | 0.05 | 0.18 | 0.2 | 4.1 | 4.3 | no breakage | no breakage | ◎ |
| 1-10 | 0.05 | 0.72 | 0.8 | 4.1 | 4.3 | no breakage | no breakage | ◎ |
| 1-11 | 0.05 | 0.81 | 0.9 | 4.1 | 4.3 | breakage | breakage | X |
| 1-12 | 0.05 | 0.4 | 0.4 | 4.1 | 4.1 | no breakage | breakage | ○ |
| 1-13 | 0.05 | 0.32 | 0.4 | 4.1 | 4.5 | no breakage | no breakage | ◎ |
| 1-14 | 0.05 | 0.44 | 0.4 | 4.5 | 4.3 | no breakage | breakage | ○ |
| 1-15 | 0.05 | 0.4 | 0.4 | 4.5 | 4.5 | no breakage | breakage | ○ |
| 1-16 | 0.05 | 0.36 | 0.4 | 4.5 | 4.7 | no breakage | no breakage | ◎ |

In 16 types of spark plug samples, at least one of the positional value ΔH, the curvature radius R of the curved surface region 13C, the first outer diameter ϕ1 and the second outer diameter ϕ2 was varied. The curvature radius R was set to 0.1 mm, 0.2 mm, 0.4 mm, 0.8 mm or 0.9 mm. The first outer diameter ϕ1 was set to 4.1 mm or 4.5 mm. The second outer diameter ϕ2 was set to 4.1 mm, 4.3 mm, 4.5 mm or 4.7 mm.

The positional value ΔH was set to −0.1 mm, 0 mm, 0.05 mm, 0.35 mm, 0.4 mm, 0.7 mm or 0.75 mm. The length H1 of the curved surface region 13C in the axial direction was set depending on the curvature radius R, the first outer diameter ϕ1 and the second outer diameter ϕ2.

As is seen from TABLE 1, the samples 1-2 to 1-4, 1-6 and 1-8 to 1-16 were configured to satisfy the condition of 0≤ΔH≤H1. In other words, the front end P5 of the inner circumferential surface 50B of the metal shell 50 was arranged to face the curved surface region 13C of the ceramic insulator 10 in the direction perpendicular to the axial direction in each of the samples 1-2 to 1-4, 1-6 and 1-8 to 1-16.

The sample 1-1 was configured to satisfy the condition of ΔH<0 such that the front end P5 of the inner circumferential surface 50B of the metal shell 50 was located in front of the front end P1 of the curved surface region 13C of the ceramic insulator 10. The samples 1-5 and 1-7 were configured to satisfy the condition of ΔH>H1 such that the front end P5 of the inner circumferential surface 50B of the metal shell 50 was located in rear of the rear end P2 of the curved surface region 13C of the ceramic insulator 10.

In Evaluation Test 1, two samples were prepared for each sample type and tested by two respective test operations, test operation A and test operation B. In the test operation A, the discharge test was performed for 20 hours at a rate of 60 spark discharges per second in a pressurized chamber of 5 MPa. The spark discharges were generated, while heating with a burner, in such a manner that the temperature of the front end of the ceramic insulator reached 900 degrees Celsius. In the test operation B, the discharge test was performed under more extreme conditions than in the test operation A. More specifically, the discharge test was performed in a pressurized chamber of 10 MPa. The other conditions of the test operation B were the same as those of the test operation A. The higher the pressure inside the chamber, the less likely it is that there will arise a normal voltage in the spark discharge gap between the electrode tip 29 of the center electrode 20 and the electrode tip 33 of the ground electrode 30, and the more likely it is that a penetration breakage will occur.

After the discharge test, the sample was disassembled and tested for the occurrence or non-occurrence of a penetration breakage in the ceramic insulator 10. The occurrence or non-occurrence of the penetration breakage was visually checked by making a penetrated and broken site or sites of the ceramic insulator 10 visible with the application of a red check liquid.

In TABLE 1, the occurrence or non-occurrence of the penetration breakage is indicated for each of the test operations A and B. The evaluation criteria were as follows: "×" when the penetration breakage was found in the sample after both of the test operation A and the test operation B; "○" when the penetration breakage was not found in the sample was after the test operation A but was found in the sample after the test operation B; and "◎" when the penetration breakage was not found in the sample after either of the test operation A and the test operation B.

The samples where the condition of 0≤ΔH≤H1 was not satisfied, i.e., the sample 1-1 of ΔH<0 and the samples 1-5 and 1-7 of ΔH>H1, were evaluated as "×". The sample 1-8 where the curvature radius R was smaller than 0.2 mm and the sample 1-11 where the curvature radius R was larger than 0.8 mm were also evaluated as "×".

The samples 1-2 to 1-4, 1-6, 1-9, 1-10 and 1-12 to 1-16 where both of the conditions of 0≤ΔH≤H1 and 0.2 mm≤R≤8 mm were satisfied were evaluated as "○" or "◎".

The reasons for these test results are assumed as follows.

As an example of the occurrence of an unintentional spark discharge in a space other than the normal spark discharge gap, it is most conceivable that a spark discharge occurs between the front end P5 of the inner circumferential surface 50B of the metal shell 50 and the center electrode 20 because of the reason that a sharp region (edge region) such as the front end P5 of the inner circumferential surface 50B of the metal shell 5 tends to sustain concentration of electric field and thereby serve as a starting point of the spark discharge.

In the case of 0≤ΔH≤H1, i.e., in the case where the front end P5 of the inner circumferential surface 50B of the metal shell 50 is arranged to face the curved surface region 13C of the ceramic insulator 10 in the direction perpendicular to the axial direction, it is highly likely that the unintentional spark discharge will develop via a creepage path RT1 as shown in FIG. 3. Namely, the spark discharge is likely to run from the front end P5 of the inner circumferential surface 50B of the metal shell 50 to the center electrode 20 along the outer circumferential surface 13B, the curved surface region 13C and then the front end surface 13A of the ceramic insulator 10 because the spark discharge is guided to the front end surface 13A by the curved surface region 13C. There occurs no penetration breakage in the ceramic insulator 10 when the unintentional spark discharge develops via the creepage path RT1.

By contrast, it is highly likely that the unintentional spark discharge will develop via a penetration path RT2 as shown in FIG. 3 in the case of ΔH>H1, i.e., in the case where the front end P5 of the inner circumferential surface 50B of the metal shell 50 is located in rear of the rear end P2 of the curved surface region 13C of the ceramic insulator 10. Namely, the spark discharge is likely to run from the front end P5 of the inner circumferential surface 50B of the metal shell 50 to the outer circumferential surface 13B of the ceramic insulator 10 and then run from the outer circumferential surface 13B to the center electrode 20 through the inside of the ceramic insulator 10 (leg portion 13) without being guided to the front end surface 13A. This results in a high possibility of the occurrence of a penetration breakage in the ceramic insulator 10.

In the case of ΔH<0, i.e., in the case where the front end P5 of the inner circumferential surface 50B of the metal shell 50 is located in front of the front end P1 of the curved surface region 13C of the ceramic insulator 10, the distance from the front end P5 of the inner circumferential surface 50B of the metal shell 50 to the surface (outer circumferential surface 13B or front end surface 13A) of the ceramic insulator 10 becomes long so that a region of the outer circumferential surface 50B of the metal shell 50 located in rear of the front end 5P, rather than the front end 5P of the inner circumferential surface 50B of the metal shell 50, will serve as the starting point of the unintentional spark discharge. This also results in a high possibility of the occurrence of a penetration breakage in the ceramic insulator 10 by the development of the unintentional spark discharge via the penetration path RT2 as shown in FIG. 3.

In the case where the curvature radius R of the curved surface region 13C is smaller than 0.2 mm, the curved surface region 13C becomes close to the sharp edge and thereby becomes susceptible to breakage due to concentration of electric field. In this case, there is a high possibility that a penetration breakage will occur in the ceramic insulator 10 even though the condition of 0≤ΔH≤H1 is satisfied.

Furthermore, the path via which the curved surface region 13C guides the spark discharge to the front end surface 13A becomes long in the case where the curvature radius R of the curved surface region 13C is larger than 0.8 mm. In this case, there is also a high possibility that a penetration breakage will occur in the ceramic insulator 10 by the development of the spark discharge through the inside of the ceramic insulator 10, rather than along the front end surface 13A of the ceramic insulator 13, even though the condition of 0≤ΔH≤H1 is satisfied.

As it is apparent from the above explanations, it is preferable to satisfy both of the conditions of 0≤ΔH≤H1 and 0.2 mm≤R≤8 mm. In other words, it is preferable that: the front end P5 of the inner circumferential surface 50B of the metal shell 50 is arranged to face the curved surface region 13C of the ceramic insulator 10 in the direction perpendicular to the axial direction; and the curvature radius R of the curved surface region 13C is set larger than or equal to 0.2 mm (millimeters) and smaller than or equal to 0.8 mm (millimeters). It is possible by this configuration to effectively prevent the occurrence of the penetration breakage in the ceramic insulator 10.

The samples 1-2 to 1-4, 1-6, 1-9, 1-10 and 1-12 to 1-16 where the conditions of 0≤ΔH≤H1 and 0.2 mm≤R≤8 mm were satisfied will be explained in more detail below. Among these samples, 8 types of samples 1-2 to 1-4, 1-6, 1-9, 1-10, 1-13 and 1-16 where the second outer diameter ϕ2 was larger than the first outer diameter ϕ1 were evaluated as "◎"; and 3 types of samples 1-12, 1-14 and 1-15 where the second outer diameter ϕ2 was smaller than or equal to the first outer diameter ϕ1 were evaluated as "○".

The reasons for these test results are assumed as follows.

As the density of the ambient air decreases with increase in temperature, it becomes more likely that the spark discharge will occur due to decrease in electrical resistance. By contrast, it becomes less likely that the spark discharge will occur due to increase in electrical resistance as the density of the ambient air increase with decrease in temperature.

In the case where the second outer diameter ϕ2 is larger than the first outer diameter ϕ1, the volume of the ceramic insulator 10 in the vicinity of the front end of the ceramic insulator 10 decreases toward the front end. As a result, the temperature in the vicinity of the ceramic insulator 10 becomes higher toward the front end of the ceramic insulator 10 and becomes lower toward the rear end of the ceramic insulator 10. Thus, the likelihood that the spark discharge will develop via the creepage path RT1 along the front end surface 13A of the ceramic insulator 10 can be increased to relatively decrease the likelihood that the spark discharge will develop via the penetration path RT2 on the rear side with respect to the front end surface 13A of the ceramic insulator 10 for more effective prevention of the penetration breakage in the ceramic insulator 10.

As is apparent from the above explanations, it is more preferable that the second outer diameter ϕ2 is set larger than the first outer diameter ϕ1. In other words, it is preferable that the outer circumferential surface 13B of the ceramic insulator 10 increases in outer diameter from the front end to the rear end. It is possible by this configuration to more effectively prevent the occurrence of the penetration breakage in the ceramic insulator 10.

C. Evaluation Test 2

In Evaluation Test 2, 6 types of spark plug samples 2-1 to 2-6 were prepared so as to satisfy the preferable conditions (0≤ΔH≤H1 and 0.2 mm≤R≤8 mm) as proved by Evaluation Test 1, and then, subjected to operation test as shown in TABLE 2. The common dimensions of the spark plug samples were as follows: the inner diameter ϕ4 of the front end part of the ceramic insulator 10 was 2.3 mm; the inner diameter ϕ3 of the front end part of the metal shell 50 was 7.2 mm; the positional value ΔH was 0.05 mm; the curvature radius R was 0.4 mm; and the first outer diameter ϕ1 was 4.1 mm.

TABLE 2

| Sample No. | θ1 (degree) | Damage amount (mm) | Evaluation result |
|---|---|---|---|
| 2-1 | 0 | 0.14 | x |
| 2-2 | 5 | 0.09 | ○ |
| 2-3 | 10 | 0.08 | ○ |
| 2-4 | 20 | 0.07 | ○ |
| 2-5 | 30 | 0.05 | ○ |
| 2-6 | 40 | — | — |

In 6 types of spark plug samples, the taper angle θ1 was varied from sample to sample. More specifically, the taper angle θ1 was set to 0 degree, 5 degrees, 10 degrees, 20 degrees, 30 degrees and 40 degrees in the samples 2-1 to 2-6, respectively. Herein, the taper angle θ1 was varied by changing the second outer diameter ϕ2. In the sample 2-1, the second outer diameter ϕ2 was set equal to the first outer diameter ϕ1 (ϕ2=ϕ1). In the samples 2-2 to 2-6, the second outer diameter ϕ2 was set larger than the first outer diameter ϕ1 (ϕ2>ϕ1).

In Evaluation Sample 2, the ground electrode 30 was removed from the sample so that normal spark discharge was disabled. The operation test was performed by mounting the sample to an internal combustion engine and then operating the internal combustion engine for 100 hours. The internal combustion engine used was an in-line 4-cylinder 1.3-L gasoline engine. This gasoline engine was operated at full throttle (WOT (Wide-Open Throttle)) and at a speed of 6000 rpm.

After the operation test, the sample was disassembled and tested for the depth of damage to the front end (front end surface 13A and curved surface region 13C) of the ceramic insulator 10 in the axial direction with the use of a three-dimensional shape measuring device (more specifically, X-ray CT scanner). The maximum value of the measured damage depth was determined as the damage amount of the sample. The evaluation criteria were as follows: "○" when the damage amount of the sample was less than 0.1 mm; and "×" when the damage amount of the sample was more than or equal to 0.1 mm.

The sample 2-1 where the taper angle θ1 was smaller than 5 degrees was evaluated as "×". The damage amount of the sample 2-1 reached 0.14 mm and significantly exceeded 0.1 mm. The samples 2-2 to 2-5 where the taper angle θ1 was larger than or equal to 5 degrees and smaller than or equal to 30 degrees were evaluated as "○". In these samples 2-2 to 2-5, the damage amount decreased with increase in the taper angle θ1.

As to the sample 2-6 where the taper angle θ1 was 40 degrees and was larger than 30 degrees, it was impossible complete the operation of the internal combustion engine due to the occurrence of pre-ignition (premature ignition). The damage amount of the sample 2-6 was not thus evaluated. It is herein noted that the pre-ignition is a defective state where fuel gas is ignited at an earlier timing than a normal timing in the combustion chamber of the internal combustion engine.

The reasons for these test results are assumed as follows.

In the case where the taper angle θ1 is larger than or equal to 0 degree, the ceramic insulator 10 decreases in volume toward the front end. The larger the taper angle θ1, the smaller the volume of the front end of the ceramic insulator 10, and the higher the temperature of the front end of the ceramic insulator 10. As the temperature of the front end of the ceramic insulator 10 increases, the density of the ambient air becomes decreased to cause a decrease in electrical resistance. This leads to a decrease in the discharge voltage of the spark discharge along the front end surface 13A of the ceramic insulator 10 so as to allow a reduction of spark energy. In consequence, the amount of damage to the front end of the ceramic insulator 10 by the spark discharge decreases with increase in the taper angle θ1. The front end of the ceramic insulator 10 can be effectively prevented from being damaged by the spark discharge in the case where the taper angle θ1 is larger than or equal to 5 degrees.

In the case where the taper angle θ1 is larger than 30 degrees, the volume of the front end of the ceramic insulator 10 becomes excessively small so that the front end of the ceramic insulator 10 gets overheated. There is thus a high possibility that misfiring such as pre-ignition will occur by the overheated front end of the ceramic insulator 10 in the case where the taper angle θ1 is larger than 30 degrees.

As is apparent from the above explanations, it is preferable that the taper angle θ1 is larger than or equal to 5 degrees and smaller than or equal to 30 degrees. By this configuration, it is possible to suppress the amount of damage caused to the front end of the ceramic insulator 10 by the spark discharge and improve the durability of the spark plug. It is also possible to prevent the occurrence of misfiring such as pre-ignition by the overheated front end of the ceramic insulator 10.

D. Modifications (1) It is considered that it is possible in the above embodiment to prevent the occurrence of a penetration breakage in the spark plug 100 by satisfaction of $0 \leq \Delta H \leq H1$ and $0.2\ mm \leq R \leq 0.8\ mm$. The factors other than these parameters, such as the material and detail dimensions of the metal shell 50, the material and detail dimensions of the ceramic insulator 10 etc., can be adjusted as appropriate. For example, it is feasible to use nickel-or zinc-plated low carbon steel or low carbon steel with no plating as the material of the metal shell 50. It is also feasible to use any insulating ceramic material other than alumina as the material of the ceramic insulator 10.

(2) In the above embodiment, the configuration of the spark plug has been explained by way of example. However, the above embodiment is merely one example of the present invention. Various changes and modifications of the above embodiment are possible depending on the purpose of use of the spark plug, the performance required of the spark plug and the like. For example, the present invention can be embodied as a lateral discharge type spark plug where a spark discharge occurs in a direction perpendicular to the axial direction, rather than a vertical discharge type spark plug where a spark discharge occurs in the axial direction. Although the present invention has been described with reference to the above specific embodiment and modifications, the above embodiment and modifications are intended to facilitate understanding of the present invention and are not intended to limit the present invention thereto. Without departing from the scope of the present invention, various changes and modifications can be made to the present invention; and the present invention includes equivalents thereof.

DESCRIPTION OF REFERENCE NUMERALS

5: Gasket
6: Ring member,
8: Plate packing
9: Talc
10: Ceramic insulator
12: Through hole
13: Leg portion
13A: Front end surface
13B: Outer circumferential surface
13C: Curved surface region
15: Step portion
16: Step portion
17: Front body portion
18: Rear body portion
19: Collar portion
20: Center electrode
21: Electrode body
22: Core
23: Head portion
24: Collar portion
25: Leg portion
29: Electrode tip
30: Ground electrode
31: Electrode body
33: Electrode tip
40: Metal terminal
41: Cap attachment portion

42: Collar portion
43: Leg portion
50: Metal shell
50: Inner circumferential surface
50A: Front end surface
50B: Inner circumferential surface
50C: Chamfered region
51: Tool engagement portion
52: Mounting thread portion
53: Crimped portion
54: Seat portion
56: Step portion
58: Compression-deformed portion
59: Insertion hole
60: Conductive seal
70: Resistor
80: Conductive seal
100: Spark plug Having described the invention, the following is claimed:

1. A spark plug, comprising:

an insulator having a front end part and a through hole formed in the direction of an axis of the spark plug;

a rod-shaped center electrode inserted in the through hole and extending in the direction of the axis;

a metal shell disposed around an outer circumference of the insulator; and a ground electrode electrically conducted with the metal shell and adapted to define a gap between the ground electrode and the center electrode, wherein the front end part of the insulator has a front end surface, an outer circumferential surface, and a curved surface region extending from the front end surface to the outer circumferential surface, wherein the outer circumferential surface is located rearward of the front end surface and extends rearwardly in the direction of the axis wherein, in a cross section including the axis, a front end of an inner circumferential surface of the metal shell is disposed opposite the curved surface region in a direction perpendicular to the axis, and wherein the curved surface region has a curvature radius in a range from 0.2 mm to 0.8 mm.

2. The spark plug according to claim 1, wherein the outer circumferential surface of the insulator has an outer diameter increasing from a front end to a rear end thereof.

3. The spark plug according to claim 1, wherein, in the cross section including the axis, two contours of the outer circumferential surface of the insulator form an acute angle of 5 degrees to 30 degrees.

4. The spark plug according to claim 2, wherein, in the cross section including the axis, two contours of the outer circumferential surface of the insulator form an acute angle of 5 degrees to 30 degrees.

5. A spark plug, comprising:

an insulator having a front end part and a through hole formed in the direction of an axis of the spark plug;

a rod-shaped center electrode inserted in the through hole and extending in the direction of the axis;

a metal shell disposed around an outer circumference of the insulator; and a ground electrode electrically conducted with the metal shell and adapted to define a gap between the ground electrode and the center electrode, wherein the front end part of the insulator has a front end surface, an outer circumferential surface, and a curved surface region extending from the front end surface to the outer circumferential surface, wherein the outer circumferential surface is located rearward of the front end surface and extends rearwardly in the direction of the axis, wherein, in a cross section including the axis, a front end of an inner circumferential surface of the metal shell is disposed opposite an axial length of the curved surface region in a direction perpendicular to the axis, and wherein the curved surface region has a curvature radius in range from 0.2 mm to 0.8 mm.

6. A spark plug, comprising:

an insulator having a front end part and a through hole formed in the direction of an axis of the spark plug;

a rod-shaped center electrode inserted in the through hole and extending in the direction of the axis;

a metal shell disposed around an outer circumference of the insulator; and a ground electrode electrically conducted with the metal shell and adapted to define a gap between the ground electrode and the center electrode, wherein the front end part of the insulator has a front end surface, an outer circumferential surface, and a curved surface region extending from the front end surface to the outer circumferential surface, wherein the curved surface region has a curvature radius in a range from 0.2 mm to 0.8 mm, wherein the outer circumferential surface is located rearward of the front end surface and extends rearwardly in the direction of the axis, and wherein, in a cross section including the axis, a front end of an inner circumferential surface of the metal shell is disposed opposite the curvature radius of the curved surface region in a direction perpendicular to the axis.

* * * * *